US005127675A

United States Patent [19]

Moss

[11] Patent Number: 5,127,675

[45] Date of Patent: Jul. 7, 1992

[54] METHOD FOR MARKING AN ARTICLE FOR IDENTIFICATION AND DESCRIPTION AND A LABEL DEVICE THEREFOR

[76] Inventor: James W. Moss, 4423 Burgundy Dr., Louisville, Ky. 40299

[21] Appl. No.: 524,548

[22] Filed: May 17, 1990

Related U.S. Application Data

[62] Division of Ser. No. 931,342, Nov. 17, 1986, Pat. No. 4,936,606.

[51] Int. Cl.[5] ..... B42D 15/00

[52] U.S. Cl. ..... 283/70; 283/81; 283/92

[58] Field of Search ..... 283/81, 70, 99, 107, 283/100, 92, 101; 40/159, 299, 595, 615, 638, 360, 628

[56] References Cited

U.S. PATENT DOCUMENTS

| | | | |
|---|---|---|---|
| 2,156,018 | 4/1939 | Humphner | 283/92 |
| 2,213,666 | 9/1940 | Burke | 283/100 |
| 2,591,779 | 4/1952 | Buck | 40/595 |
| 3,315,387 | 4/1967 | Heuser | 283/81 |
| 3,679,448 | 7/1972 | Tramposch | 283/107 |
| 3,914,483 | 10/1975 | Stipek, Jr. | 283/81 |
| 4,235,459 | 11/1980 | Callahan | 40/634 |
| 4,276,334 | 6/1981 | Sugihara | 283/81 |
| 4,741,793 | 5/1988 | Jones | 40/615 |

OTHER PUBLICATIONS

Plastic Pharmaceutical Container from a Local Drug Store.

*Primary Examiner*—Frank T. Yost
*Assistant Examiner*—Hwei-Siu Payer
*Attorney, Agent, or Firm*—Jon C. Winger

[57] ABSTRACT

A label for marking an article for identification and description includes a sheet of material such as paper or vinyl having one surface coated with an adhesive material, and at least one closed peripheral cut formed through the sheet defining the external boundary of identification and descriptive indicia. A method for marking an article for identification and description includes making at least one closed peripheral cut through a sheet of material in selected portions of the sheet to define the external boundary of identification and descriptive indicia, adhesively attaching the closed peripheral cut out portions of the sheet to a surface of the article, and covering the closed peripheral cut out portions and an area of the article surface beyond the external boundary of the closed peripheral cut out portions with a covering material thereby producing a three-dimensional image of the closed peripheral cut out portions.

7 Claims, 2 Drawing Sheets

METHOD FOR MARKING AN ARTICLE FOR IDENTIFICATION AND DESCRIPTION AND A LABEL DEVICE THEREFOR

This is a continuation of application Ser. No. 06/931,342, filed Nov. 17, 1986 now patented, U.S. Pat. No. 4,936,606.

BACKGROUND OF THE INVENTION

1. Field of the Invention

The present invention relates to devices and methods for labeling articles, and more particularly to a method for marking an article for identification and description, and a labeling device therefor which is tamper resistant and leaves a tell-tale trace when so tampered with.

2. Description of the Prior Art

Motor vehicle theft is becoming an increasing problem. Often, motor vehicles are stolen and canibilized for their parts which are then sold individually. The problem has become so acute that the U.S. Government has passed legislation requiring various components of vehicles sold in the United States to be permanently marked with vehicle identification numbers so that they can be more readily traced if the motor vehicle is stolen.

The problem is coming up with a device and method for marking motor vehicle components with identification and descriptive indicia which meets a number of requirements. Among these requirements are: it must not add any significant cost to the manufacturer either in material or time required to apply the marks; it must be permanent; it must be tamper resistant; if tampered with, it must leave a tell-tale trace showing that it was tampered; and it must be difficult to counterfeit. Furthermore, from a practical standpoint, it must not distort or blemish the marked article.

Various methods and devices for marking articles are known, but each has a drawback.

For example, it is known to attach an identification plate to an article by rivets. However, rivets distort or blemish the article, and can be relatively easily be removed. Further, after removal, a counterfeit plate can be easily substituted without a trace of the substitution.

By way of further example, identifying marks can be stamped or otherwise embossed in an article. However, such stamping or embossing is time consuming adding cost to the manufacture of the article, and also distorts or blemishes the article.

SUMMARY OF THE INVENTION

The present invention recognizes the drawbacks of heretofore known marking methods and devices, and provides a solution which meets all of the above-mentioned requirements.

More particularly, the present invention provides in one advantageous embodiment, a method for marking an article for identification and description comprising removing selected closed peripheral portions of material from selected areas of a sheet of material to define identification indicia, adhesively attaching the sheet of material in overlaying relationship to a surface of the article; and covering the sheet of material and an area of the article surface beyond the marginal edge of the sheet of material.

The present invention, in another embodiment provides a method for marking an article for identification and description comprising making at least one closed peripheral cut-out portion through a sheet of material in a selected location of the sheet defining the external boundary of identification and description indicia, overlaying the sheet of material on a surface of the article to be marked, adhesively attaching the closed peripheral cut out portions of the sheet to the article surface, and covering the closed peripheral cut out portions and an area of the article surface beyond the marginal edge of the closed peripheral cut out portions.

The present invention also provides a label for marking an article with identification and description indicia comprising a sheet of material having selected closed peripheral portions of the material removed from selected areas of the sheet defining open areas in the sheet, the peripheral edge of the open areas defining identification and descriptive indicia, and adhesive material coating one surface of the sheet.

The present invention further provides a label for marking an article with identification and description indicia comprising a sheet of material with at least one closed peripheral cut out portion through the sheet, the peripheral edge of the cut out portion defining the external boundary of the identification and description indicia, and adhesive material coating one surface of the cut out portions.

BRIEF DESCRIPTION OF THE DRAWINGS

A better understanding of the present invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
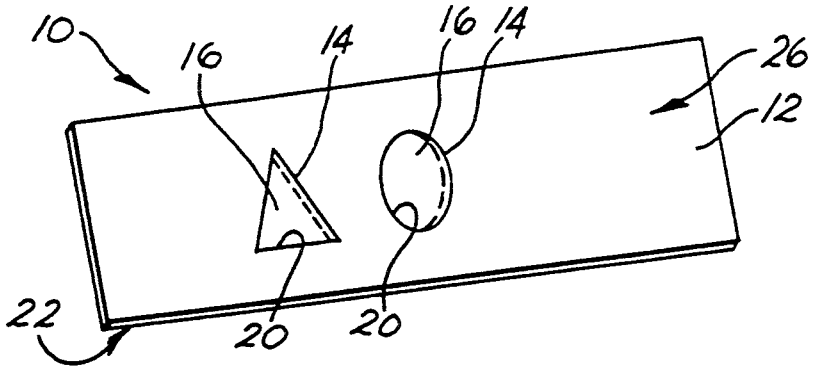
FIG. 1 is a perspective view of one embodiment of a label of the present invention.
Figure 2A:
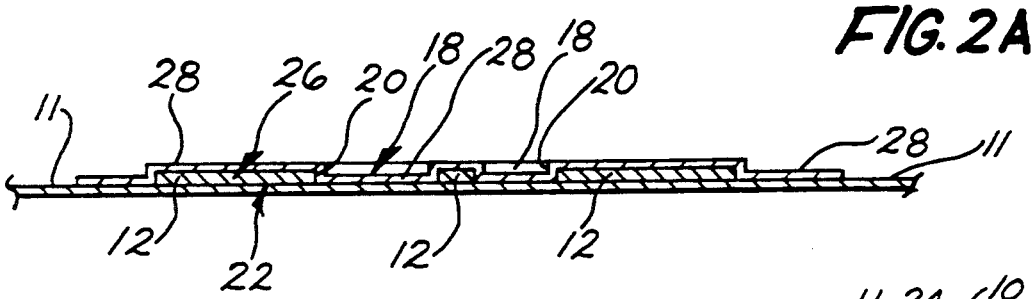
FIG. 2A is a sectional view taken along line 2A—2A of FIG. 2.
Figure 2:
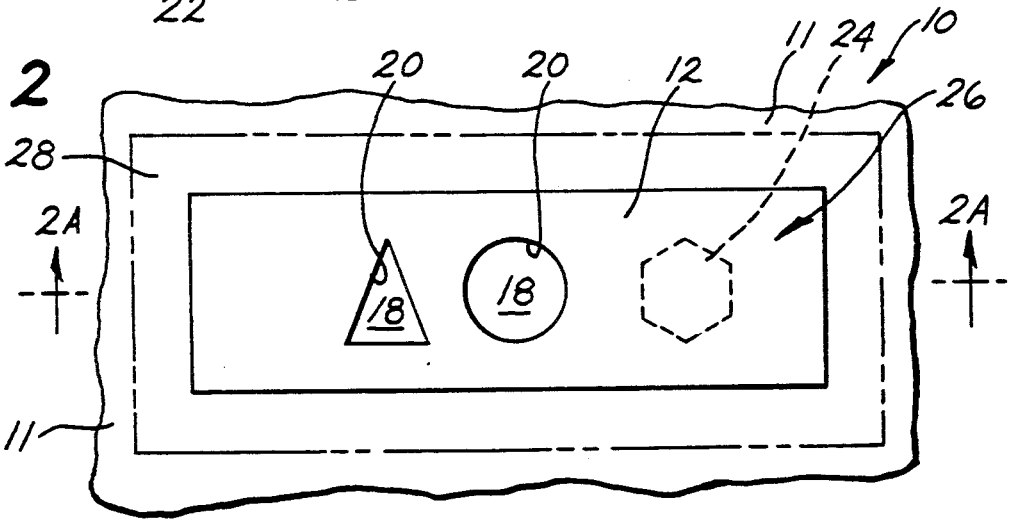
FIG. 2 is a plan view of the label of FIG. 1 applied to an article surface.

With reference to FIGS. 1 and 2, there is shown a label, generally denoted as the numeral 10, for marking an article 11 with identification and description indicia.

The label 10 is shown as including a sheet of flexible material 12. Selected closed peripheral cuts 14 are formed through the sheet 12 in predetermined location of the sheet 12. The closed peripheral cuts 14 define closed peripheral portions 16 which when removed from the sheet 12 leave open areas 18 in the sheet 12. The peripheral edge 20 of each open area 18 defines the identification and description indicia. The indicia can be numerals, letters, a continuation of numerals and letters, a logo, or virtually any shape which may be used to identify, decorate, or describe the article 11.

One surface 22 of the sheet 12 has a coating of adhesive for adhesively attaching the label 10 to a surface of the article 11. In addition, the adhesive material can include a fluorescing material. The fluorescing material would leave a tell-tale trace on the article 11 if the label 10 is removed from the article 11. The tell-tale trace would be invisible under natural light but would be visible under fluorescent light.

In addition, the label 10 can also include printed indicia 24 on the other surface 26 of the sheet 12 from the surface 22 having the adhesive. The indicia 24 is printed on the sheet surface 26 in the locations outside of the closed peripheral portion 16. The printed indicia 24 can be in the form of, for example, a logo. Further, the printed indicia 24 can be printed with a fluorescing ink so that it will be invisible in natural light, but visible under fluorescent light. The printed indicia 24 will function to make counterfeiting of the label 10 very difficult.

The material of the sheet 12 is very thin, for example, a sheet of vinyl or paper. In addition, the material of the sheet 12 can be frangible.

In use of the label 10, the closed peripheral portions 16 are removed from the sheet 12 and the sheet 12 is applied to a surface of the article 11 with the adhesive side 22 of the sheet 12 against the surface of the article 11. Next, a covering, generally denoted as the number 28, is applied over the entire surface 26 of the sheet 12 including the open areas 18 defined by the removed peripheral portions 16 and also over an area of the surface of the article 11 beyond the margin of the sheet 12. The covering 28 can be, for example, an overlay of a thin (0.001 inch) sheet of vinyl having a pressure sensitive adhesive on one side thereof, or a coating of paint or a resin with, or without an included fluorescing material. The covering 28 protects the label 10 from moisture and makes it very difficult to remove the label 10. The covering 28 also provides a tell-tale trace if the label 10 is tampered with or removed.

Figure 3:
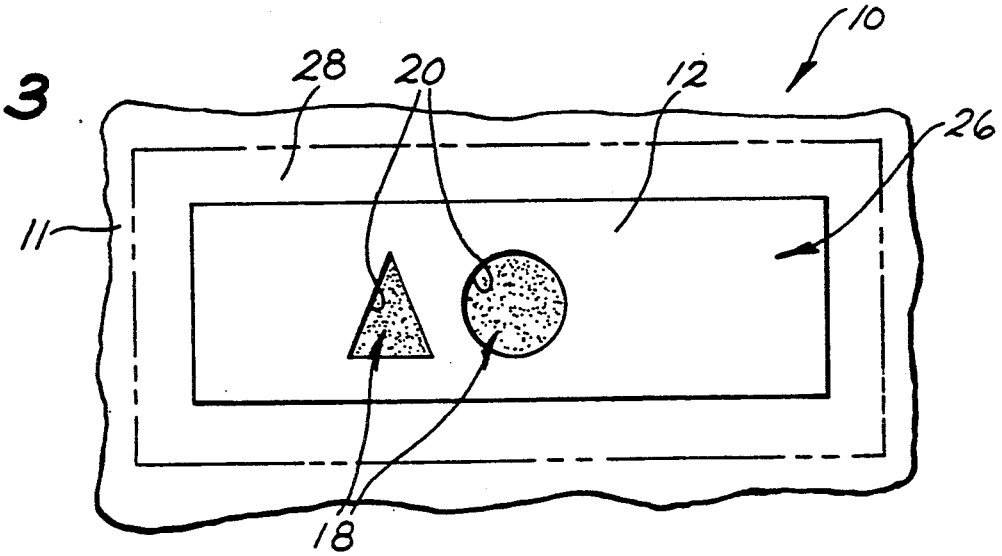
FIG. 3 is a plan view of the label of FIG. 1 applied to an article surface including an additional feature.

With continued reference to FIG. 1 and additional reference to FIG. 3, the areas of the surface of the article 11 exposed by the open areas 18 defined by the removed peripheral portions 16 of the sheet 12 may be etched (as indicated by the mottling in FIG. 3) before the coating 28 is applied. The etching can be accomplished with, for example, acid or sandblasting. Thus, if the label 10 is somehow removed from the surface of the article 11, the indicia will still be evident and difficult to remove from the article surface because the etching would have to be ground away, and the grinding away will cause a distortion in the surface of the article 11.

Figure 4:
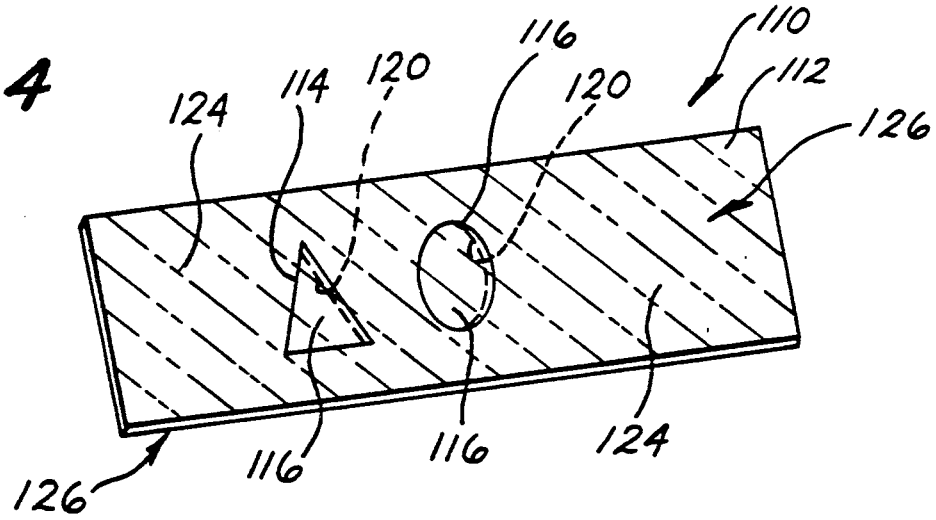
FIG. 4 is a perspective view of another embodiment of a label of the present invention.
Figure 5:
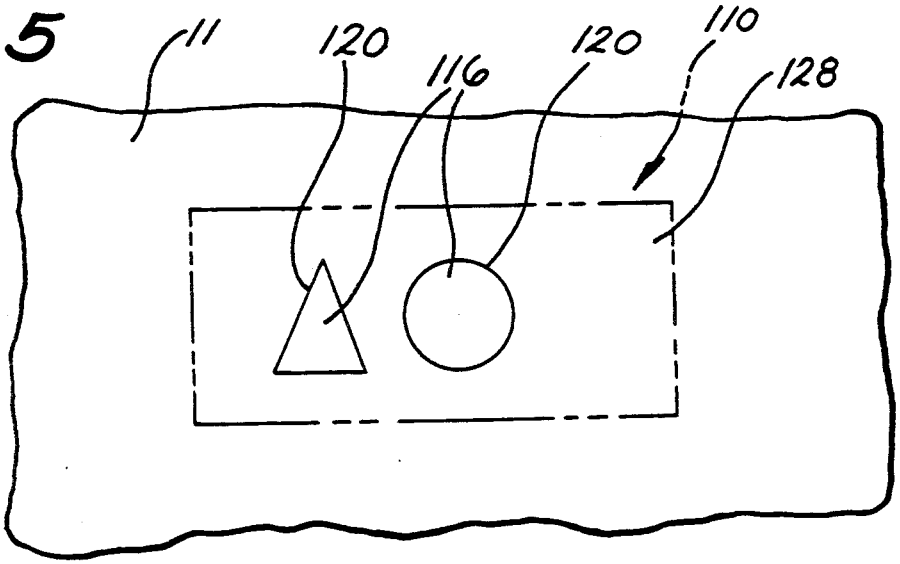
FIG. 5 is a plan view of the label of FIG. 4 applied to an article surface; and, FIG. 6 is a plan view of the label of FIG. 4 applied to a article surface including an additional feature.

Now with reference to FIGS. 4 and 5, there is shown a label, generally denoted as the numeral 110, for marking an article 11 with identification and description indicia.

The label 110 is shown as including a sheet of flexible material 112. Selected closed peripheral cuts 114 are formed through the sheet 112 in predetermined locations of the sheet 112. The closed peripheral cuts 114 define cut out portions 116. The peripheral edge 120 of each cut out portion 116 defines the external boundary of the identification and description indicia. The indicia can be numerals, letters, a combination of numerals and letters, a logo, or virtually any shape which may be used to identify or describe the article 11.

One surface 122 of the sheet 112 has a coating of adhesive for adhesively attaching the cut out portions 116 to a surface of the article 11. In addition, the adhesive material can include a fluorescing material.

In addition, the label 110 can also include printed indicia 124 on the other surface 126 of the sheet 12 from the surface 122 having the adhesive. The indicia 124 can be, for example, in the form of a logo, or as shown, lines which extend across the cut out portions 116. Further, the printed indicia 124 can be printed with a fluorescing ink so that it will be invisible in natural light but visible under fluorescent light.

The material of the sheet 12 is very thin, for example, a sheet of vinyl or paper. In addition, the material of the sheet 112 can be fangible.

In use of the label 110, the sheet 112 is applied to a surface of the article with the adhesive side 122 of the sheet 112 against the surface of the article 11. The sheet 112 is then removed leaving the cut out portions 116 adhesively affixed in place on the surface of the article 11. Next, a covering, generally denoted as the number 128, is applied over the cut out portions 116 and an area of the surface of the article beyond the margins of the cut out portions 116. The covering 128 can be for example, an overlay of a thin (0.001 inch) sheet vinyl having a pressure sensitive adhesive on one side thereof, or a coating of a paint or a resin with or without an included fluorescing material.

Figure 6:
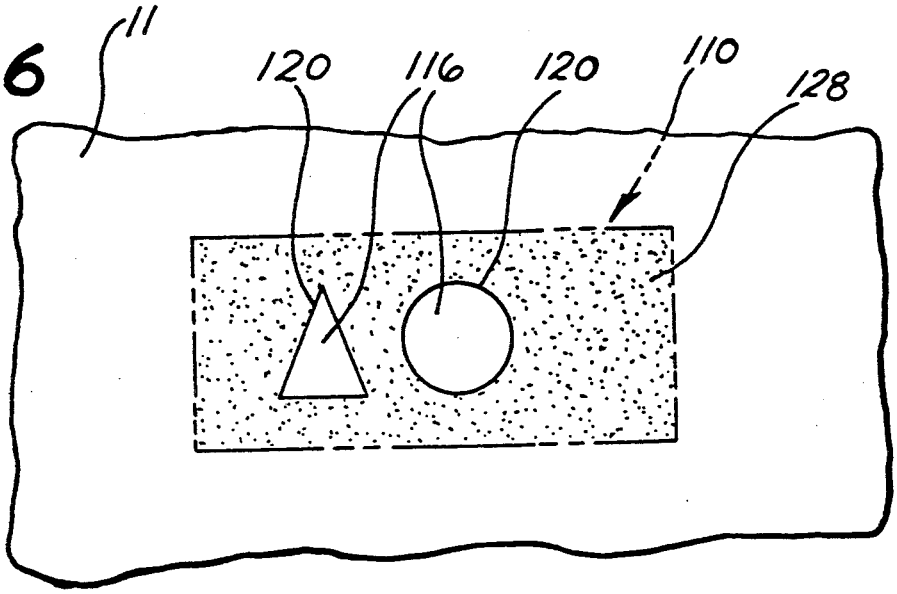

With continued reference to FIG. 4 and addition reference to FIG. 6, the areas of the surface of the article 11 outside or beyond the margins of the cut out portions 116 may be etched (as indicated by the mottling in FIG. 6) before the covering 128 is applied. The etching can be accomplished with, for example, acid or sandblasting.

When the label 10, 110 is applied to a surface of the article 11, it presents a three-dimensional identification and description indicia on the article 11.

The foregoing detailed description is given primarily for clearness of understanding and no unnecessary limitations are to be understood therefrom for modifications will become obvious to those skilled in the art and may be made without departing from the spirit of the invention or scope of the appended claims.

What is claimed is:

1. A method for marking an article for identification and description comprising the steps of:

removing selected closed peripheral portions of material from a sheet of material, the peripheral edge of each closed peripheral portion defining the exterior boundary identification and description indicia;

adhesively attaching the closed peripheral portions of material in overlaying relationship to a surface of the article;

covering the closed peripheral portions of material and an area of the surface of the article beyond the peripheral edge of each of the closed peripheral portions of material with a liquid material; and allowing the liquid material to dry.

2. The method of claim 1 further comprising the step of adding a fluorescing material to the liquid covering material prior to the step of covering the closed peripheral portions of material.

3. A method for marking an article for identification and description comprising the steps of:

removing selected closed peripheral portions of material from a sheet of material, the peripheral edge of each closed peripheral portion defining the exterior boundary identification and description indicia;

adhesively attaching the closed peripheral portions of material in overlaying relationship to a surface of the article;

etching the surface of the article outside the peripheral edges of the closed peripheral portions of material; and, covering the closed peripheral portions of material and the etched area of the surface of the article beyond the peripheral edge of each of the closed peripheral portions of material with a covering material which adheres to the closed peripheral portions of material and the etched area of the surface of the article beyond the peripheral edge of each of the closed peripheral portions of material thereby producing a three-dimensional image of the closed peripheral cut-out portions.

4. An article of manufacture comprising:

an article;

closed peripheral portions of material each having a peripheral edge defining the exterior boundary of intoxication or description indicia attached to the article in overlaying relationship to a surface of the article in spaced-apart relationship thereon;

a continuous layer of covering material covering the closed peripheral portions of material and an area of the surface of the article beyond the peripheral edge of each of the closed peripheral portions; and the covering material is opaque.

5. The article of claim 4, wherein an area of the surface of the article beyond the peripheral edge of each of the closed peripheral portions is etched.

6. The article of claim 4, wherein the covering material is colored.

7. The article of claim 4, wherein the covering material includes a fluorescing material.

* * * * *